United States Patent [19]

Leuenberger

[11] Patent Number: 4,744,067

[45] Date of Patent: May 10, 1988

[54] ANALOG ELECTRONIC WATCH

[76] Inventor: Claude-Eric Leuenberger, Grand Chézard 5, CH-2054 Chezard, Switzerland

[21] Appl. No.: 917,134

[22] Filed: Oct. 9, 1986

[30] Foreign Application Priority Data

Oct. 11, 1985 [CH] Switzerland ..... 04408/85

[51] Int. Cl.[4] ..... G04B 19/04

[52] U.S. Cl. ..... 368/80; 368/223

[58] Field of Search ..... 368/76, 80, 157, 160, 368/223, 224, 66

[56] References Cited

U.S. PATENT DOCUMENTS 4,102,119 7/1978 Seikosha ..... 368/224

FOREIGN PATENT DOCUMENTS 0048217 3/1982 European Pat. Off. .
2279184 2/1976 France .
2331828 6/1977 France .
1419489 12/1975 United Kingdom .
2037025 7/1980 United Kingdom .

*Primary Examiner*—Vit W. Miska

[57] ABSTRACT

An analog electronic watch comprising electronic circuitry is described, a first motor for driving hours and minutes hands, a second motor for driving a seconds hand, and a photoelectric sensor connected to the circuitry is described. The sensor reacts to strong ambient light by producing a first signal. In response to this signal the circuitry issues control signals to the two motors to activate them. If the light fades, the sensor produces a second signal and the circuitry then only issues control signals to the first motor. Stopping the second motor, when the light becomes too dim to read the time, saves energy. A memory circuit enables the seconds hand to be synchronized with the minutes hand whenever the ambient light becomes sufficiently strong to warrant activation of the second motor.

3 Claims, 2 Drawing Sheets

AMPLI-FIER
COMPA-RATOR
FF
COUNTER ÷60
CONTROL CIRCUIT
CONTROL CIRCUIT
DIVID. ÷60
FF
DIVID. ÷26
DIVIDER ÷29
SUSTAI-NING CIRCUIT
64Hz
1Hz

ANALOG ELECTRONIC WATCH

FIELD OF THE INVENTION

This invention relates to an electronic watch for indicating the time analogically with hours, minutes and seconds hands, and more particularly a watch having a pair of stepping motors, with the first motor driving the hours and minutes hands and the second motor driving the seconds hand, the second motor only being activated when a logic detection signal, applied to its control circuit, is at a set logic level.

BACKGROUND OF THE INVENTION

A watch of this kind is for instance described in European patent specification 0048217. In this construction, the detection signal is provided by a two-position contact that can be activated from outside the watch case. In one contact position the watch is in its normal operating condition, with both motors working; and in the other position of the contact the watch is in an economical operating condition; with the motor that drives the seconds hand being at a stop.

The energy consumption of the electronic circuitry as such being low, that of the watch as a whole is largely attributable to the motor driving the seconds hand since it is required to work sixty times more often than the other motor. An economical mode of operation, with the seconds hands at a stop, enables the life of the watch's cell to be considerably lengthened, without affecting the time indicated by the other two hands.

However, having to activate the above contact is a bothersome task so that one often forgets to go over to the economical mode of operation when, for instance, the watch is not being worn, with the result that the economical aspect of such a watch construction is largely lost.

SUMMARY OF THE INVENTION

To overcome this drawback the invention provides an electronic watch having hours, minutes and seconds hands for indicating the time, comprising:

an oscillator supplying a time-base signal;

a time-keeping circuit for receiving said signal and a detection signal able to assume two logic levels, said circuit being arranged to permanently issue a first control signal and to issue a second control signal solely when said detection signal is at a particular logic level;

a first motor for driving the hours and minutes hands in response to the first control signal;

a second motor for driving the seconds hands in response to the second control signal;

a photoelectric sensor arranged to receive light impinging on the watch and issuing a signal representative of the intensity of said light; and a detection circuit connected to said sensor and issuing said detection signal which is arranged to assume a first logic level when the intensity of the light is below a set threshold and a second logic level when said intensity is above said threshold, the time-keeping circuit issuing the second control signal when the detection signal is at its second logic level.

Thus, with such a watch, the seconds hand will stop automatically when the incident light becomes too dim to read the time and will start moving, again automatically, as soon as the light exceeds a set intensity threshold.

When switching from the economical mode of operation to the normal mode of operation, the seconds hand ceases to be synchronization with the minutes hand and such synchronisation cannot be restored, as in the above prior construction.

To avoid this, the watch according to the invention further comprises, according to a preferred embodiment, a memory circuit adapted to synchronize the seconds hand with the minutes hand when the watch switches from the economical mode of operation to the normal mode of operation.

BRIEF DESCRIPTION OF THE DRAWINGS

In the accompanying drawings, given by way of example.

DETAILED DESCRIPTION OF THE INVENTION

Figure 1:
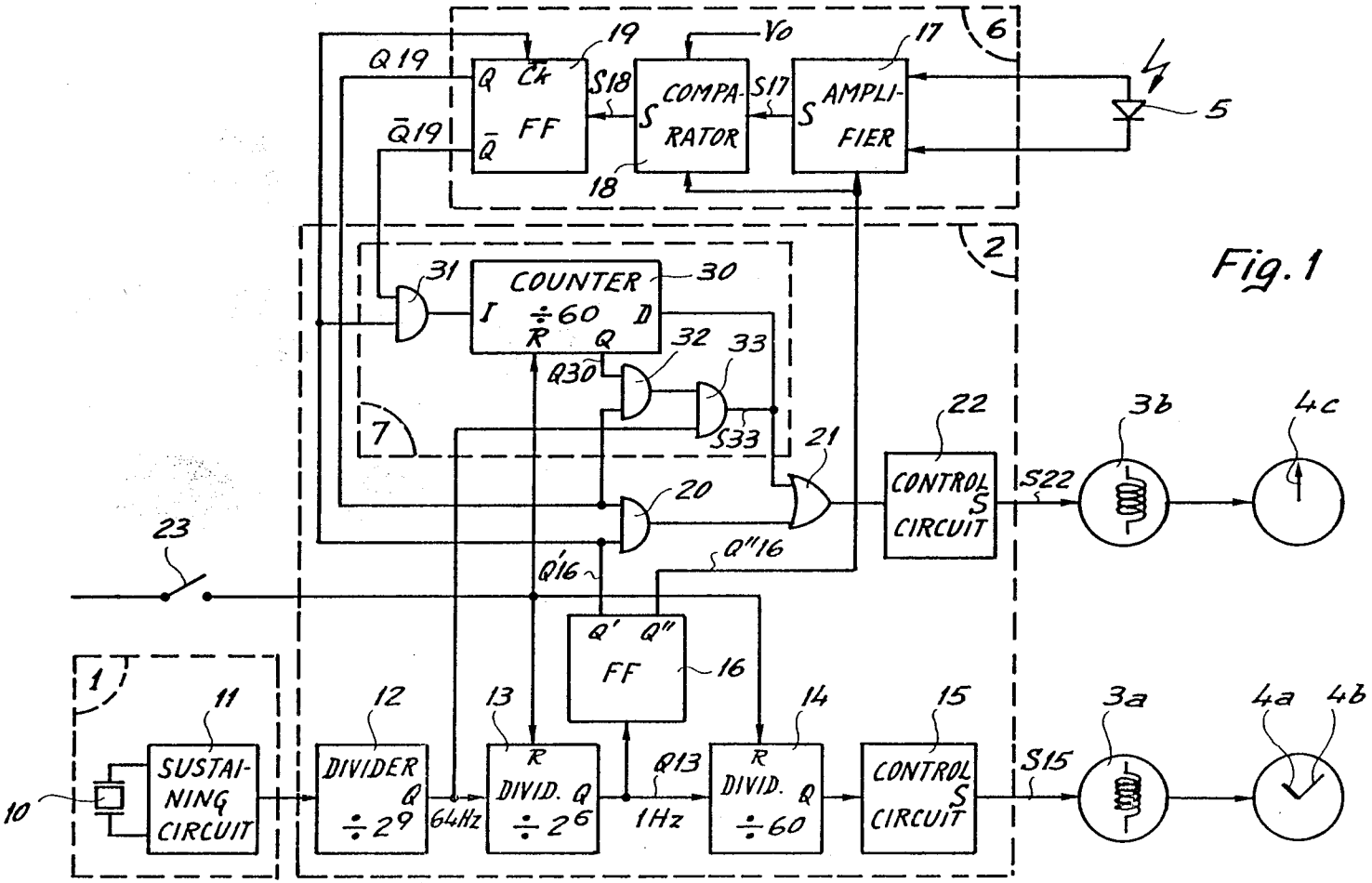
FIG. 1 schematically shows the main components of a watch according to the invention along with a diagram of its electronic circuitry.

The watch shown in FIG. 1 comprises electronic circuitry that includes an oscillator 1, a time-keeping circuit 2 and a detection circuit 6. The watch further comprises a pair of stepping motors 3*a* and 3*b* with the first driving an hours hand 4*a* and a minutes hand 4*b* and the second driving a seconds hand 4*c*, a photoelectric sensor 5 and a resetting contact 23 controlled for instance by a time-setting stem (not shown).

Oscillator 1 consists of a quartz resonator 10 and of a sustaining circuit 11 which issues, on its output, a time base or reference signal having for instance a frequency of 32768 Hz.

Time-keeping circuit 2 includes a first frequency divider 12 which receives on its input the time base signal. The output of divider 12, which is made up of nine binary dividers, issues a 64 Hz signal that is applied to the input of a second divider 13, made up of six binary dividers. Divider 13 issues on its output Q a signal Q13 having a frequency of 1 Hz.

The frequency of signal Q13 is divided by 60 in a divider 14 which thus issues on its output Q a signal consisting of one pulse per minute. This signal is applied to the input of a first control circuit 15 that produces a control signal S15 for stepping motor 3*a* such as to cause it to move forward one step per minute. Motor 3*a* drives, via a gear train, not shown, a minutes hand 4*b* and an hours hand 4*a*, and possibly a calendar. Depending on the reducing ratio of the gear train, the motor may carry out more than one step per minute.

Signal Q13 is also applied to the input of a circuit 16 consisting of two monostable flip-flops. The outputs Q' and Q'' of circuit 16 respectively issue signals Q'16 and Q''16 produced by the flip-flops. Signal Q'16 has a frequency of 1 Hz and is made up of five pulses of duration to, i.e. of a few milliseconds, typically 5 ms. Signal Q''16 is similar to signal Q'16, but its pulses are a longer duration, e.g. of 2 to.

Figure 2:
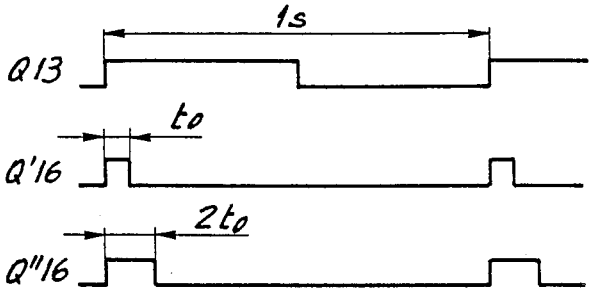
FIGS. 2 and 3 are graphs representing various signals produced in the circuitry of FIG. 1.

Signals Q13, Q'16 and Q''16 are represented in FIG. 2, which shows that the rising edges of all pulses are in synchronism.

Time-keeping circuit 2 further includes a memory circuit 7, which for the time being will be assumed to be disconnected, and AND gate 20 having two inputs one of which receives signal Q'16, an OR gate 21 having two inputs one of which is connected to the output of AND gate 20, and a second control circuit 22 which is connected to the output of OR gate 21 and which produces a control signal S22 for motor 3*b* such as to cause it to move forward one step per second. Motor 3*b* drives seconds hand 4*c* via a gear train not shown.

Hands 4*a*, 4*b* and 4*c* may of course be arranged to rotate about a single axis over a common dial.

The operation of the watch will now be described on the assumption that the second input of AND gate 20 is high and that the second input of OR gate 21 receives no signal.

Under such conditions, with motor 3*a* normally driving forward the hours hand 4*a* and the minutes hand 4*b*, signal Q'16 passes through AND gate 20 and OR gate 21 to reach the input of circuit 22 which, by producing control signal S22 for motor 3*a*, causes seconds hand 4*c* to be driven forward at the rate of one step per second.

The watch thus acts in this case like a conventional watch, indicating the hours, minutes and seconds.

If, however, the second input of AND gate 20 is low, signal Q'16 can no longer pass through it and motor 3*b* remains idle. The logic level of the signal being applied to the second input of gate 20 thus controls whether motor 3*b* is operative or not.

This logic signal is taken off the output of detection circuit 6, which will now be described and to which photoelectric sensor 5 is connected. Sensor 5 is placed behind a window, not shown, formed in the dial or in the case middle to receive light impinging on the watch and to measure the intensity of this light. It may for instance consist of a photodiode, a phototransistor or a photoresistance.

Circuit 6 includes an amplifier 17 to which is connected sensor 5, represented in the form of a photodiode. Amplifier 17 supplies on its output S an analogue signal S17 having an amplitude representative of the intensity of the light impinging on the photodiode. Signal S17 is then compared with a constant reference signal Vo, supplied by a conventional circuit not shown, in a comparator 18 which issues a logic output signal S18. Depending on whether S17 is less than or equal to Vo, or is greater than Vo, signal S18 will respectively be, for instance, high or low. Signal S18 is applied to the input of a bistable flip-flop 19 having an inverted clock input $\overline{Ck}$, that is sensitive to the falling edge of signal Q'16, a main logic output Q and an inverted logic outlet $\overline{Q}$. Output Q issues a logic signal Q19 that constitutes the main output signal of circuit 6. Output $\overline{Q}$ issues a signal $\overline{Q}$19, that is the inverse of signal Q19.

Flip-flop 19 thus memorizes for one second, on its output Q, the state of signal S18 from the instant the falling edge of a pulse Q'16 appears. If therefore photoelectric sensor 5 receives light having an intensity that is less than of equal to a certain critical threshold corresponding to value Vo of signal S17, signal S19 will be low. But if the light intensity is greater than this threshold, signal Q19 will be high and will be applied to the second input of AND gate 20.

It follows for the above the motor 3*b* and seconds hand 4*c* are stationary or in motion depending on whether sensor 5 receives light having an intensity that is respectively less or greater than the critical threshold, thereby enabling the watch to be put automatically in a normal mode of operation or, as the case may be, in an economical mode of operation.

The successive changeovers from one mode of operation to the other cause the seconds hand to become desynchronized in relation to the other hands, assuming the watch to have been initially set to the right time. Such changeovers are likely to be frequent since they may result from mere a masking of sensor 5 by the watch wearer's sleeve.

Memory circuit 7 enables the seconds hand to be rapidly brought into synchronism with the minutes hand when the watch changes over to the normal mode of operation, such that the seconds hand will indicate 60 seconds when the minutes hand indicates a full minute, this condition having initially been satisfied when time setting the watch.

It comprises a counter by sixty 30 and three two-input AND gates 31, 32 and 33. Counter 30 has an incrementing input I, a decrementing input D and a resetting input R. Input I is connected to the output of AND gate 31 whose first input receives signal Q'16 and second input receives signal $\overline{Q}$19. Input D is connected to the output of AND gate 33 and to the second input of OR gate 21. The first input of AND gate 33 receives the 64 Hz signal issued by frequency divider 12 while its second input is connected to the output of AND gate 32. The first input of AND gate 32 is connected to the second input of AND gate 20 and to the output Q of flip-flop 19 to receive signal Q19. And counter 30 has an output Q that issues a logic signal Q30 to the second input of AND gate 32.

Figure 3:
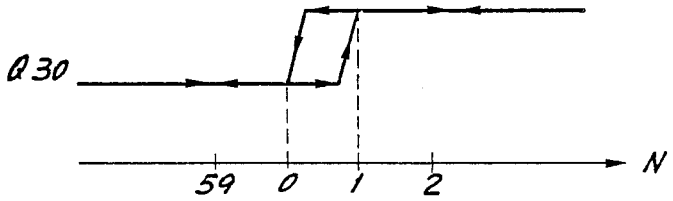

The logic state of signal Q30 depends on number N in counter 30, in accordance with the FIG. 3 graph. Suppose first that signal Q30 is low and that pulses are being applied to the input I of counter 30 to increment it. The contents of counter 30 will increase till N=59 and an extra pulse will then cause it to become zero. This incrementation of counter 30 does not influence the state of signal Q30 which remains low. But the following pulse, by causing N to proceed from zero to 1, causes signal Q30 to switch from low to high and signal Q30 will remain high even if counter 30 further receives an arbitrary number of incrementing pulses. Suppose next that pulses are being applied to the input D of counter 30 to decrement it. Its contents will end up with N=1. This decrementation has no effect on the Q output of the counter so that signal Q30 will remain high, assuming it was high to begin with. But the next pulse, which causes N to go from 1 to zero, will cause signal Q30 to switch from high to low and signal Q30 will then remain so regardless of the number of subsequent pulses that are received by the input D of counter 30.

Circuit 7, in conjunction with the other portions of the circuitry shown, operates as follows.

Suppose first sensor 5 is receiving high intensity light and the contents of counter 30 are zero. Signal Q19 will then be high and signals $\overline{Q}$19 and Q30 low. AND gate 20, on receiving signal Q19, thus lets seconds signal Q'16 through to the input of circuit 22 via OR gate 21. Signal Q'16 however will not reach the input I of counter 30 via AND gate 31 as the latter is closed by signal $\overline{Q}$19. The low logic level of signal Q30 causes an identical signal to issue from the output of AND gate 32, thereby preventing the 64 Hz signal from reaching circuit 22 via AND gate 33 and OR gate 21. Thus, in this instance, counter 30 will receive no pulse on its input I, while seconds signal Q'16, which reaches the input of second control circuit 22 along, will cause seconds hand 4c to move forward to show the right time along with the hours and minutes hands 4a and 4b.

Suppose next, sensor 5 is receiving no light, with the contents of counter 30 still being zero. Signals Q19 and Q30 are then low and signal $\overline{Q}$19 is high. AND gate 20 is thus closed by signal Q19 and AND gate 31 is opened by signal $\overline{Q}$19. Since seconds signal Q'16 can no longer reach the input of circuit 22, seconds hand 4c will be immobilized. Signal Q'16 can however reach the input I of counter 30 and will increment the latter as long as sensor 5 is masked, say 16 seconds. As soon as a counting pulse reaches input I, signal Q30 goes high. The output of AND gate 32 will however carry on being low as one of its inputs receives signal Q19 which is now also low, thereby closing AND gate 33 to the 64 Hz signal.

As long as sensor 5 remains masked, seconds hand 4c remains stationary, whereas counter 30 carries on being incremented by signal Q'16 pulses with the other hands moving forward normally.

After the above 16 seconds, sensor 5 will again receive light thus reverting to the initially considered case except that the contents of counter 30 will now be 16 instead of zero and that signal Q30 will now be high with the result that AND gate 33 and AND gate 20 will let the 64 Hz signal and signal Q'16 through respectively.

The 64 Hz signal is also a signal for rapidly catching up or retrieving the seconds lost by hand 4c while sensor 5 was masked. This signal is so phased, in relation to signal Q'16, that its rising edges which trigger off the movements of motor 3b, lie between a pair of rising edges of signal Q'16. Since the duration of control pulses S22 is less than the duration of half a period of the 64 Hz signal, motor 3b will be able to react to signal Q'16 and to the 64 Hz signal if they both reach circuit 22 at the same time via OR gate 21.

As soon as light reimpinges on sensor 5, the 64 Hz signal will again be applied to the input of circuit 22 and to the input D of counter 30. Each pulse of this signal will thus cause motor 3b to move forward one step and decrement the contents of counter 30 by one unit. After 16 pulses, seconds hand 4c will again give the right time and the contents of counter 30 will be returned to zero, so that signal Q30 will be low, AND gate 33 will be closed and the 64 Hz signal will be blocked.

Seconds hand 4c will thus have caught up the lost time, in this case in $16\times1/64=0.25$ second, and if the lag had been 59 steps the catching up would have taken about 0.92 second. This means that as soon as light appears the seconds hand resumes its exact position in less than one second. Should a signal Q'16 pulse appear during this catching up phase, it would cause motor 3b to move forward one extra step since the catching up pulses do not coincide with the seconds pulses.

Should motor 3b and hand 4c stop for a few whole minutes, circuit 7 would produce no catching up pulse since counter 30 is reset by each 60th incrementing pulse. Thus only if motor 3b stops for over one minute at a time will there be any saving of energy, i.e. the energy the motor does not use during the whole minute(s) it is idle.

In continuous operation, the energy consumption of circuits 17 and 18, which process the analog signals, may be relatively high. Since the output signal of circuit 18 is memorized at each second in flip-flop 19, it suffices to switch on briefly circuits 17 and 18 when memorization is being performed. To this end circuit 16 further generates a signal Q''16, shown in FIG. 2, Signal Q''16 is made up of pulses having a duration of 2 to starting at the same instant as the pulses of duration to of signal Q'16. Now signal Q'16 is the clock signal that is applied to the input $\overline{Ck}$ of flip-flop 19 and which reacts to the falling edges of the pulses. Since the falling edges are in the middle of the signal Q''16 pulses, signal Q''16 may be used to operate periodically circuits 17 and 18.

To this end, signal Q''16 is fed into these circuits where, by known means, it switches on the energy supply for 2 to and switches it off for the remainder of the period. If 2 to=10 ms, energy consumption is reduced a hundred fold.

Under such conditions, the consumption of detection circuit 6 is typically 0.05 μA and that of oscillator 1 and of time-keeping circuit 2 about 0.1 μA each. At the rate of three steps per minute, the consumption of motor 3a is less than 0.05 μA, while that of motor 3b lies between 0.5 and 1 μA. These are mean currents, supplied by a cell of 1.5 V not shown in FIG. 1.

When both motors are working, the watch will consume between 0.7 and 1.2 μA, and only 0.2 μA when motor 3b is idle.

This example highlights the advantages of the watch described and illustrated from an energy saving point of view since seconds motor 3b is automatically stopped at night and whenever sensor 5 is not illuminated in daytime.

These stopages of motor 3b are not bothersome for time reading purposes as seconds hand 4c ressumes its exact position at worst in less than one second from the moment lighting conditions become normal again.

In order for second hand 4c, after a stopage of motor 3b, to return to its exact position wherein it is in synchronism with minutes hand 4b, i.e. for it to reach the 60 seconds mark as minutes hand 4b comes to indicate a full minute, it must already initially have satisfied this condition when time setting the watch.

To this end, contact 23 is for instance coupled with the time-setting stem (not shown) of the watch such that the stem will close contact 23 when it is moved to its time-correcting position. Contact 23 then produces a signal that is applied to reset inputs R of dividers 13 and 14 and of counter 30 thereby achieving the desired synchronisation once the time-setting stem has been returned to its normal position.

Figure 4A:
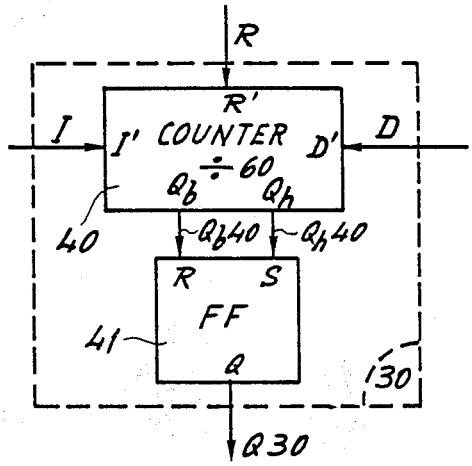
FIG. 4*a* illustrates a modified form of construction for a portion of the circuitry of FIG. 1.
Figure 4B:
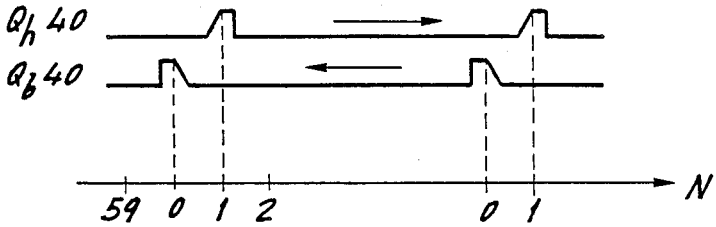
FIG. 4*b* is a graph representing various signals produced by the circuit of FIG. 4*a*.

The output Q of counter 30 produces a signal Q30 having a particular shape, shown in FIG. 3. A form of construction for counter 30 with known components for producing such a signal is shown in FIG. 4a. In this circuit use is made to two RCA, type CD 40192, 4-bit counters and of a conventional RS bistable flip-flop 41. Both 4-bit counters are so connected as to form a counter by sixty 40 having an incrementing input I', a decrementing input D', a resetting input R', an underflow (or borrow) output Qb and an overflow (or carry) output Qh. Inputs I', D' and R' correspond to the inputs I, D and R of counter 30 in FIG. 1. Outputs Qb and Qh respectively issue signals Qb40 and Qh40 which are represented in FIG. 4b in dependence on the contents N of the counter. Signals Qh40 and Qb40 include each a brief pulse whenever the contents of the counter proceed from 0 to 1 and for 1 to 0 respectively. By applying signals Qb40 and Qh40 to the inputs R and S, respectively, of flip-flop 41, output Q of the latter will produce the desired signal Q30.

The invention is not limited to the above described embodiment. For example, the watch could contain more than two motors, with each motor driving one or more display elements and with photoelectric sensor 5 controlling the operation of one or more motors. Further, one or more motors could, with advantage, consist of motors of known type able to rotate in either direction, with the catching up operation being carried out in whatever direction requiring the least number of steps on the part of each motor.

I claim:

1. An electronic watch having hours, minutes and seconds hands for indicating the time, comprising:

an oscillator for supplying a time-base signal;

a time-keeping circuit for receiving said time-base signal and a detection signal which is able to assume two logic levels, said time-keeping circuit being arranged to permanently issue a first control signal and to issue a second control signal only when said detection signal is at a particular logic level;

a first motor for driving the hours and minutes hands in response to the first control signal;

a second motor for driving the seconds hand in response to the second control signal;

a photoelectric sensor arranged to receive light impinging on the watch and to issue a signal representative of the intensity of said light; and a detection circuit connected to said sensor for issuing said detection signal which is arranged to assume a first logic level when the intensity of the light is below a predetermined threshold and a second logic level when said light intensity is above said threshold, said time-keeping circuit issuing the second control signal only when said detection signal is at its second logic level so that said second motor drives the seconds hand only when said detection signal is at its second logic level and energy consumption for the watch is automatically reduced when said light intensity is below said threshold.

2. An electronic watch as in claim 1, further comprising a memory circuit whose function is to issue to the second motor, when the detection signal is at its second logic level, a number of correction pulses that enable the seconds hand to be moved into synchronism with the minutes hand.

3. An electronic watch as in claim 1, further comprising means for activating at least a portion of the detection circuit only periodically so as to reduce energy consumption by said portion.

* * * * *